US011161347B2

(12) United States Patent
Westermeyer

(10) Patent No.: US 11,161,347 B2
(45) Date of Patent: Nov. 2, 2021

(54) CIRCUIT BOARD FOR A PRINTING CARTRIDGE, PRINTING CARTRIDGE, AND PRINTING SYSTEM

(71) Applicant: Artech GmbH design + production in plastic, Dortmund (DE)

(72) Inventor: Marc Westermeyer, Duesseldorf (DE)

(73) Assignee: Artech GmbH design + production in plastic, Dortmund (DE)

( * ) Notice: Subject to any disclaimer, the term of this patent is extended or adjusted under 35 U.S.C. 154(b) by 0 days.

(21) Appl. No.: 16/638,852

(22) PCT Filed: Jul. 19, 2018

(86) PCT No.: PCT/EP2018/069598

§ 371 (c)(1),
(2) Date: Feb. 13, 2020

(87) PCT Pub. No.: WO2019/034360

PCT Pub. Date: Feb. 21, 2019

(65) Prior Publication Data

US 2020/0361212 A1 Nov. 19, 2020

(30) Foreign Application Priority Data

Aug. 14, 2017 (EP) ..... 17186212

(51) Int. Cl.
*B41J 2/175* (2006.01)
*B41J 2/14* (2006.01)

(52) U.S. Cl.
CPC ..... *B41J 2/1753* (2013.01); *B41J 2/14072* (2013.01); *B41J 2/17526* (2013.01)

(58) Field of Classification Search
CPC ..... B41J 2/14521; B41J 2/14072; B41J 2/17526; B41J 2/1753; B41J 2002/14491
See application file for complete search history.

(56) References Cited

U.S. PATENT DOCUMENTS

2012/0056954 A1* 3/2012 Asauchi et al. ..... B41J 2/1753
2012/0056955 A1 3/2012 Kodama et al.

FOREIGN PATENT DOCUMENTS

| | | |
|---|---|---|
| DE | 212012000242 | 8/2014 |
| EP | 1792733 | 6/2007 |
| EP | 1800872 | 6/2007 |
| EP | 3001316 | 3/2016 |
| EP | 3168048 | 5/2017 |

(Continued)

OTHER PUBLICATIONS

English translation of International Report on Patentability from corresponding PCT Appln. No. PCT/EP2018/069598, dated Feb. 27, 2020.

(Continued)

*Primary Examiner* — Anh T Vo
(74) *Attorney, Agent, or Firm* — Grossman, Tucker, Perreault & Pfleger, PLLC

(57) ABSTRACT

A circuit board for a printing cartridge, having a number of contact surfaces, wherein two or more of the contact surfaces are arranged in a first row, two or more of the contact surfaces are arranged in a second row, the first row is at a distance from the second row, and the contact surfaces of the second row are designed to apply a higher operating voltage than the contact surfaces of the first row.

17 Claims, 8 Drawing Sheets

(56) References Cited

FOREIGN PATENT DOCUMENTS

| | | |
|---|---|---|
| EP | 3187338 | 7/2017 |
| EP | 3392045 | 10/2018 |
| GN | 106864040 | 6/2017 |
| JP | 5-246032 | 9/1993 |
| JP | 11-320857 | 11/1999 |
| JP | 2006-297668 | 11/2006 |

OTHER PUBLICATIONS

English translation of International Search Report from corresponding PCT Appln No. PCT/EP2018/069598, dated Sep. 19, 2018.
Office Action from related Chinese Appln. No. 201880063760.3 dated Nov. 16, 2020.
Office Action from related Japanese Appln. No. 2020-530721 dated Feb. 8, 2021. English translation attached.
English translation of Third Party Observation from related EPO Appln. No. 17186212.1, dated Sep. 1, 2020.

* cited by examiner

CIRCUIT BOARD FOR A PRINTING CARTRIDGE, PRINTING CARTRIDGE, AND PRINTING SYSTEM

FIELD

The present invention relates to a circuit board for a printer cartridge, a printer cartridge having such a circuit board and a printing system.

BACKGROUND

Modern printing systems have printer cartridges that have memory and control chips or that are configured to communicate with memory and control chips. To this end, such printer cartridges usually have a circuit board that allow interfaces or contact pads for making electrically conductive connection to the printer.

The operation of such a printing system can be impaired by a leak of printing medium, for example if escaping printing medium causes a short circuit between two contact pads arranged on the circuit board. In this case, it is particularly critical if a short circuit arises between a contact pad that is coupled to a high operating voltage during operation of the printing system and a contact pad that is coupled to a low operating voltage during operation. The short circuit can damage components that are designed for operation at the low voltage, such as memory chips of the printer cartridge or the like.

SUMMARY

Against this background, the present invention is based on the technical problem of specifying a circuit board for a printer cartridge, a printer cartridge and a printing system that allow reliable operation of a printing system, wherein in particular the likelihood of a short circuit between two contact pads as a result of escaping printing medium is reduced.

According to a first aspect, the invention relates to a circuit board for a printer cartridge having a plurality of contact pads, wherein two or more of the contact pads are arranged in a first row, wherein two or more of the contact pads are arranged in a second row, wherein the first row has a spacing from the second row and wherein the contact pads of the second row are configured to apply a higher operating voltage than the contact pads of the first row. As a result of the contact pads that are configured to apply a higher operating voltage being arranged in a separate row on the circuit board and with a spacing from the contact pads of the first row, the risk of a short circuit between a contact pad of the first row and a contact pad of the second row can be decreased.

There can be provision for all contact pads that are configured to apply a higher operating voltage to be arranged in the second row. Alternatively or additionally, there can be provision for there to be provision in the second row for exclusively contact elements that are configured to apply a higher operating voltage.

There can be provision for contact pads of the first row to be configured to couple a printer to a memory chip of the printer cartridge.

When there is reference to a higher operating voltage in the present case, this is in particular a voltage that is greater than a supply voltage of a memory chip of the printer cartridge. The memory can be in particular a nonvolatile memory, such as FLASH, FERAM, EEPROM or the like.

There can be provision in the first row for precisely two, precisely three or precisely four contact pads. There can be provision in the first row for precisely four or more contact pads.

There can be provision in the second row for precisely two, precisely three or precisely four contact pads. There can be provision in the second row for precisely four or more contact pads.

In accordance with a further configuration of the circuit board, there is provision for two or more contact pads to be arranged in a third row, wherein the third row is arranged between the first row and the second row, wherein the third row has a spacing from the first row and the second row and wherein the contact pads of the second row are configured to apply a higher operating voltage than the contact pads of the third row.

There can be provision for contact pads of the third row to be configured to couple a printer to a memory of the printer cartridge.

The contact pads of the third row can in particular be configured to make a connection between a printer and a memory chip of the printer cartridge.

The contact pads of the third row can be contact pads that are intended to connect the printer to devices of the printer cartridge that are less sensitive to voltage rises than devices of the printer cartridge that are associated with contact pads of the first row. For example, the third row can have a contact pad for making contact with a grounding connection of a memory chip of the printer cartridge, while the first row has a contact pad for making contact with a data connection of a memory chip of the printer cartridge. The positioning of a third row between the first row and the second row allows the likelihood of a short circuit between a contact pad of the first row and a contact pad of the second row to be reduced.

There can be provision for a contact pad of the second row and a contact pad of the first row to have at least one contact pad of the third row arranged between them. By way of example, it is possible for merely contact pads of the first and second rows that are respectively on the outside or situated at the ends of the rows to be respectively delimited from one another by at least one contact pad of the third row, while contact pads of the first row that are on the inside or arranged in the middle of the row can have a "line of sight" to contact pads of the second row. The contact pads of the first row that are on the outside, delimited from the second row, can be for example contact pads that are configured to be coupled to an apparatus for short-circuit detection. The contact pads of the second row that are on the outside, delimited from the first row, can be for example contact pads that are configured to apply a higher voltage than contact pads of the first row that are on the inside or arranged in the middle of the row.

In accordance with a further configuration of the circuit board, there is provision for each contact pad of the second row and a contact pad of the first row to have at least one contact pad of the third row arranged between them. Contact pads of the third row can accordingly cause shading of the contact pads of the second row with respect to contact pads of the first row.

In accordance with a further configuration of the circuit board, there is provision for at least one contact pad of the third row to have a width that is greater than a width of a contact pad of the first row or of the second row. If a drop of a printing medium hits a contact pad of the third row, the drop can thus be caught, expanded or diverted in order to avoid contact with a contact pad of the second row.

The contact pads can be elevated, at least in sections, relative to a surface of a plate carrying the contact pads, can have a surface texture, can form a ledge or an edge, in order to catch, expand or divert at least part of a landing drop.

There can be provision for the first row to be arranged above the second and third rows in the state in which the circuit board has finished being mounted in a printer and for the third row to be arranged above the second row. In the event of a leak of printing medium, a drop falling by gravity accordingly initially passes through the first row, followed by the third and finally the second row. The separate, three-row arrangement of the contact pads allows the likelihood of simultaneous wetting of a contact pad of the first and second rows to be reduced.

When reference is made in the present case to a leak or escaping printing medium, this can also be fluids that escape and hit the circuit board when a further, in particular adjacent, printer cartridge, separate from the circuit board, is inserted or replaced.

Alternatively or additionally, at least one contact pad of the third row can have a height that is less than a height of a contact pad of the first row or of the second row. In this manner, contact pads of the third row can be integrated compactly on the circuit board without enlarging the circuit board layout in comparison with arrangements having for example just two rows of contact pads. Moreover, the lengthening of contact pads of the third row can promote catching and deflection of leakage drops in order to reduce the likelihood of a short circuit between contact pads of the first row and contact pads of the third row.

By way of example, there can be provision for a height of the contact pads of the third row to be less than 2 mm, in particular to be less than 1 mm, in particular to be less than 0.5 mm.

The circuit board can have a total height of 10 mm or less, for example. A contact pad of the first row or of the second row can have a height of 3 mm or less, for example.

As an alternative or in addition to contact pads, the third row can have insulating elevations made of nonconductive material in order to delimit the first row, at least in sections or completely, from the second row.

In accordance with a further configuration of the circuit board, there is provision for the contact pads to be arranged on a plate made of electrically insulating carrier material, wherein the plate has a single cutout between the contact pads of the second row, wherein at least the contact pads of the third row adjoin the cutout.

Alternatively, there can be provision for the contact pads to be arranged on a plate made of electrically insulating carrier material, wherein the plate has two or more cutouts spaced apart from one another and wherein at least one contact pad of the third row adjoins a respective one of the cutouts.

The effect that can be achieved by the above-described arrangements having one or more cutouts is that contact elements of a printer that were originally arranged in two rows for the purpose of making contact with the contact pads now form contact regions for the contact pads of the circuit board that are likewise arranged in three rows. This can be achieved by virtue of cutouts being arranged such, or a single cutout being dimensioned such, that for example the head end of contact elements engages in cutouts or the cutout, and as such the originally provided contact point on the contact elements of the printer is moved on the respectively associated contact pad of the circuit board.

Such an arrangement produces greater spacings between the contact regions that are formed between the contact pads of the circuit board and contact elements of a printer, so that the likelihood of a short circuit on account of escaping printing medium is decreased. Accordingly, the advantages according to the invention can also be achieved in conjunction with printers that were originally intended to form two-row contact regions for contact pads of a circuit board of a printer cartridge.

If there is provision for two or more spaced-apart cutouts on the circuit board, these can be cutouts formed in the style of a blind hole or a slot, for example. The cutouts or a single cutout can serve to pick up escaping printing medium or a leak of printing medium and/or to take it away from the region of the contact pads, in order to avoid a short circuit.

Movement of contact zones or contact regions between the contact pads of the circuit board and contact elements of a printer can be achieved, as an alternative or in addition to the above-described cutouts, by elevations, wherein at least two of the contact pads of the third row each have an elevation, said elevations being configured for the abutment of a respective contact element of a printer.

The elevations can accordingly produce the arrangement of contact points or contact regions for which there is provision between two-row contact elements of the printer and the contact pads of the third row, so that a three-row arrangement of contact regions is obtained between the contact pads and contact elements of a printer. In other words, elevations or cutouts between contact pads of the circuit board that are arranged in three rows and contact elements of the printer that are arranged in two rows in the uncontacted state can be used to produce a three-row arrangement of contact regions between the contact elements of the printer and contact pads of the circuit board.

The three-row arrangement, in particular in combination with cutouts for taking away printing medium leaks, allows the likelihood of a short circuit between contact pads of the second row and contact pads of the first row to be avoided.

It goes without saying that the circuit board described is suitable and intended not just for making contact with printers having contact elements arranged in two rows, but rather can also be used with printers that have contact elements arranged in three rows.

One of the contact pads of the third row can be a grounding connection, in particular a grounding connection for a memory chip of the printer cartridge.

Alternatively or additionally, one of the contact pads of the third row can be a power supply connection, particularly a power supply connection for a memory chip of the printer cartridge.

Alternatively or additionally, one of the contact pads of the third row can be a clock connection, in particular a clock connection of a memory chip of the printer cartridge.

Alternatively or additionally, one of the contact pads of the third row can be a reset connection, in particular a reset connection for a memory chip of the printer cartridge.

Alternatively or additionally, one contact pad of the third row can be a data connection, in particular a data connection for a memory chip of the printer cartridge.

There can be provision for the third row to have precisely three contact pads.

There can be provision for one contact pad of the third row to span at least two contact pads of the third row and/or the contact pads of the second row, wherein the spanning contact pad is in particular a grounding connection.

There can be provision for the first row to have precisely four contact pads and/or for the second row to have precisely two contact pads.

There can be provision for at least two contact pads of the first row to be configured to make contact with a short-circuit detection device of a printer.

Alternatively or additionally, at least one of the contact pads of the first row can be a grounding connection.

Alternatively or additionally, at least one of the contact pads of the first row can be a power supply connection.

Alternatively or additionally, at least one of the contact pads of the first row can be a clock connection.

Alternatively or additionally, at least one of the contact pads of the first row can be a reset connection.

Alternatively or additionally, at least one contact pad of the first row can be a data connection.

There can be provision for a spacing between end contact pads of the second row to be greater than a length of the first row. In this way, an offset between the contact pads of the second row and the contact pads of the first row can be achieved. In a state in which mounting is finished, it is thus possible to achieve the effect that although a drop falling or escaping in a vertical direction wets either one of the contact pads of the first row or one of the contact pads of the second row, the offset of the contact pads means that both contact pads are not wetted at the same time, as a result of which a short circuit does not arise.

There can be provision for the circuit board to have a memory, wherein the memory is connected to at least some of the contact pads and wherein the contact pads of the second row are configured to apply a voltage that is higher than the supply voltage of the memory. The memory can be in particular a nonvolatile memory, such as FLASH, FERAM, EEPROM or the like.

There can be provision for the circuit board to be connectable to a memory of the printer cartridge or to be configured to be connected to a memory of the printer cartridge, wherein at least some of the contact pads are connectable to the memory or are configured to be connected to a memory of the printer cartridge, and wherein the contact pads of the second row are configured to apply a voltage that is higher than the supply voltage of the memory. The memory can be in particular a nonvolatile memory, such as FLASH, FERAM, EEPROM or the like.

According to a second aspect, the invention relates to a printer cartridge, having a housing that has a supply volume for supplying ink having a circuit board, wherein the circuit board is formed in a manner according to the invention. For the reasons already discussed above for the circuit board, the printer cartridge according to the invention can be used to achieve reliable printing operation in a printing system.

The printer cartridge can have a memory that is connected to at least some of the contact pads of the circuit board. The memory can be in particular a nonvolatile memory, such as Flash EEPROM, FERAM (Ferro Electric Random Access Memory), EEPROM (Electrically Erasable Programmable Read-Only Memory) or the like.

According to a third aspect, the invention relates to a printing system, having a printer and a printer cartridge inserted into the printer, wherein the printer cartridge is designed in a manner according to the invention, wherein the printer has contact elements that abut the contact pads of the circuit board of the printer cartridge. The advantages of reliable printing operation on account of the reduction of the likelihood of a short circuit between contact pads on the basis of a leak of printing medium that have already been discussed with reference to the circuit board apply to the printing system.

According to a further configuration of the printing system, the contact elements and the contact pads have abutment regions formed between them, wherein the abutment regions of the contact pads of the first row are arranged in a first abutment row, and/or wherein abutment regions of the contact pads of the second row are arranged in a second abutment row and/or wherein abutment regions of the contact pads of the third row are arranged in a third abutment row, which is arranged between the first abutment row and the second abutment row.

The effect that can be achieved by a three-row arrangement of the abutment regions is that the likelihood of simultaneous impairment of multiple abutment regions by a leak of printing medium is reduced.

In accordance with a further configuration of the printing system, there is provision for a spacing between end abutment regions of the second abutment row to be greater than a length of the first abutment row. The offset between the end abutment regions of the second row opposite the abutment regions of the first row allows the likelihood of simultaneous impairment of the abutment regions of the first row and of the second row by for example a single drop of escaping printing medium to be reduced.

There can be provision for the abutment regions to have no overlap as seen in a direction transverse to the longitudinal extent of the abutment rows. In other words, the abutment regions are not in alignment as seen in a direction transverse to the longitudinal extent of the rows. The offset of the abutment regions allows simultaneous impairment of the abutment regions by for example a single drop of escaping printing medium to be avoided.

BRIEF DESCRIPTION OF THE DRAWINGS

The invention is described in more detail below on the basis of a drawing that depicts exemplary embodiments and in which, in each case schematically.

DETAILED DESCRIPTION

Figure 1:
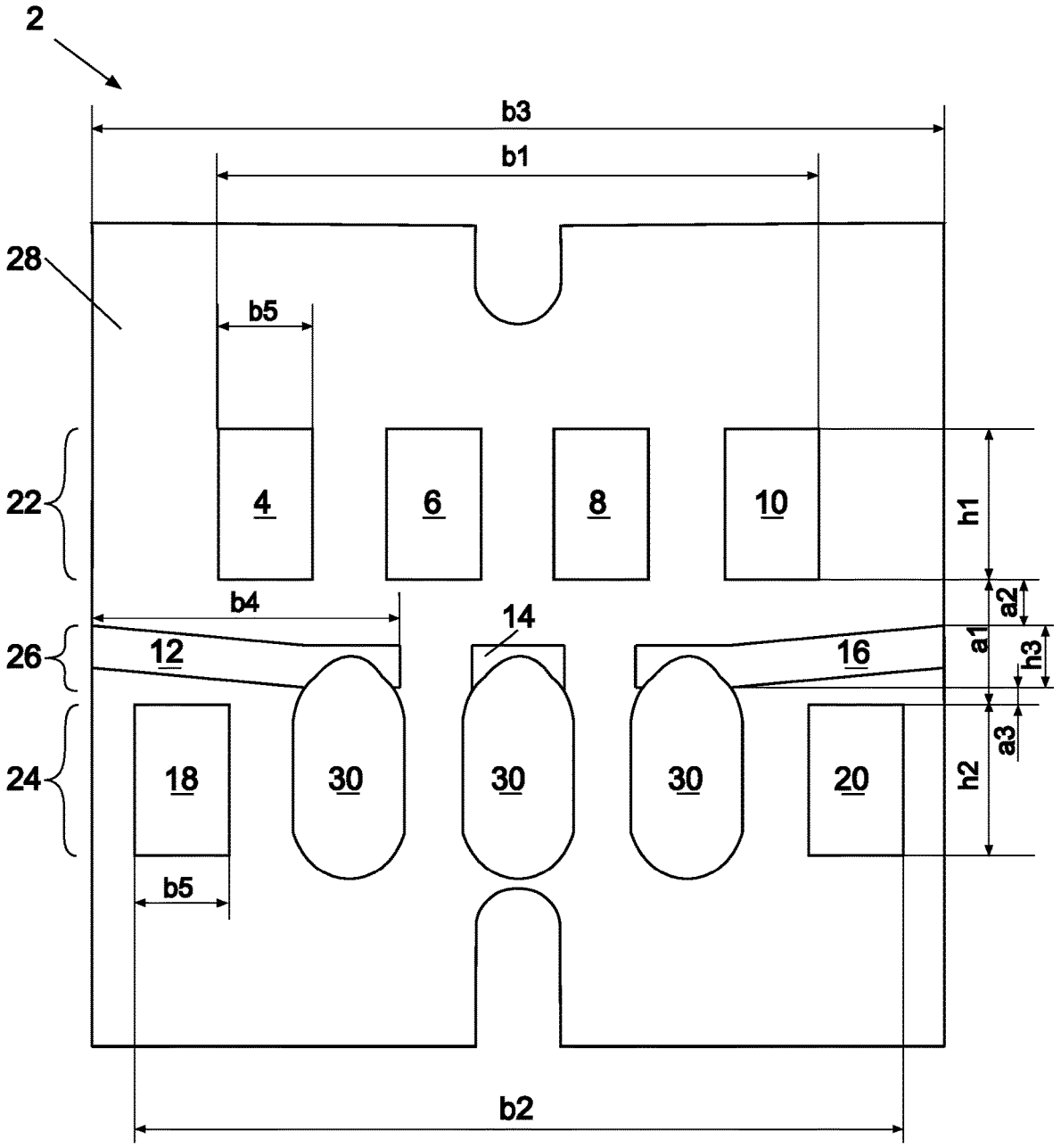
FIG. 1 shows a circuit board according to the invention.

FIG. 1 shows a circuit board 2 for a printer cartridge. The circuit board 2 has a plurality of contact pads 4, 6, 8, 10, 12, 14, 16, 18, 20.

The contact pads 4, 6, 8, 10 are arranged in a first row 22. The contact pads 18, 20 are arranged in a second row 24. The first row 22 has a spacing a1 from the second row 24. The contact pads 18, 20 of the second row 24 are configured to apply a higher operating voltage than the contact pads 4, 6, 8, 10 of the first row 22. In the present case, the second row 24 accordingly has exclusively contact pads 18, 20 arranged in it that are configured to apply a higher operating voltage than the contact pads 4, 6, 8, 10 of the first row 22.

The contact pads 12, 14, 16 are arranged in a third row 26. The third row 26 is arranged between the first row 22 and the second row 24.

The third row 26 has a spacing a2 from the first row 22. The third row 26 has a spacing a3 from the second row 24. The contact pads 18, 20 of the second row 24 are configured to apply a higher operating voltage than the contact pads 12, 14, 16 of the third row 26.

As can be seen from FIG. 1, each contact pad 18, 20 of the second row 24 and a contact pad 4, 6, 8, 10 of the first row 22 have at least one contact pad 12, 14 or 16 of the third row 26 arranged between them. The contact pads 12, 14, 16 of the third row 26 accordingly cause shadowing between the contact elements 4, 6, 8, 10 of the first row 22 and the contact pads 18, 20 of the second row 24.

The first row 22 has a height h1 and a width b1. The second row 24 has a height h2 and a width b2. The third row 26 has a height h3 and a width b3.

The contact pads 12, 16 of the third row 26 each have a width b4 that is greater than a width b5 of the contact pads of the first row 22 and of the second row 24.

The contact pads 12, 16 of the third row 26 have a height h3 that is less than a height h1 or h2 of the contact pads 4, 6, 8, 10 of the first row 22 and of the contact pads 18, 20 of the second row 24.

The contact pads 2, 4, 6, 8, 10, 12, 14, 16, 18, 20 are arranged on a plate 28 that has an electrically insulating material.

In the present case, the plate 28 has three slot-style cutouts 30 that are arranged between the contact pads 18, 20 of the second row 24. The cutouts 30 and the contact pads 12, 14, 16 adjoin one another. As can be seen from FIG. 1, one end of a respective cutouts 30 merges into a respective contact pad 12, 14, 16.

The arrangement of the contact pads 18, 20 in a separate row 24 and an arrangement of an additional row 26 between the first row 22 and the second row 24 allow in particular a leak-related short circuit between contact pads 4, 6, 8, 10 of the first row 22 and contact pads 18, of the second row 24 to be avoided.

Further variants of circuit boards are described below, wherein, to avoid repetition, identical features are assigned identical reference signs and only the differences from exemplary embodiments above are discussed.

Figure 2:
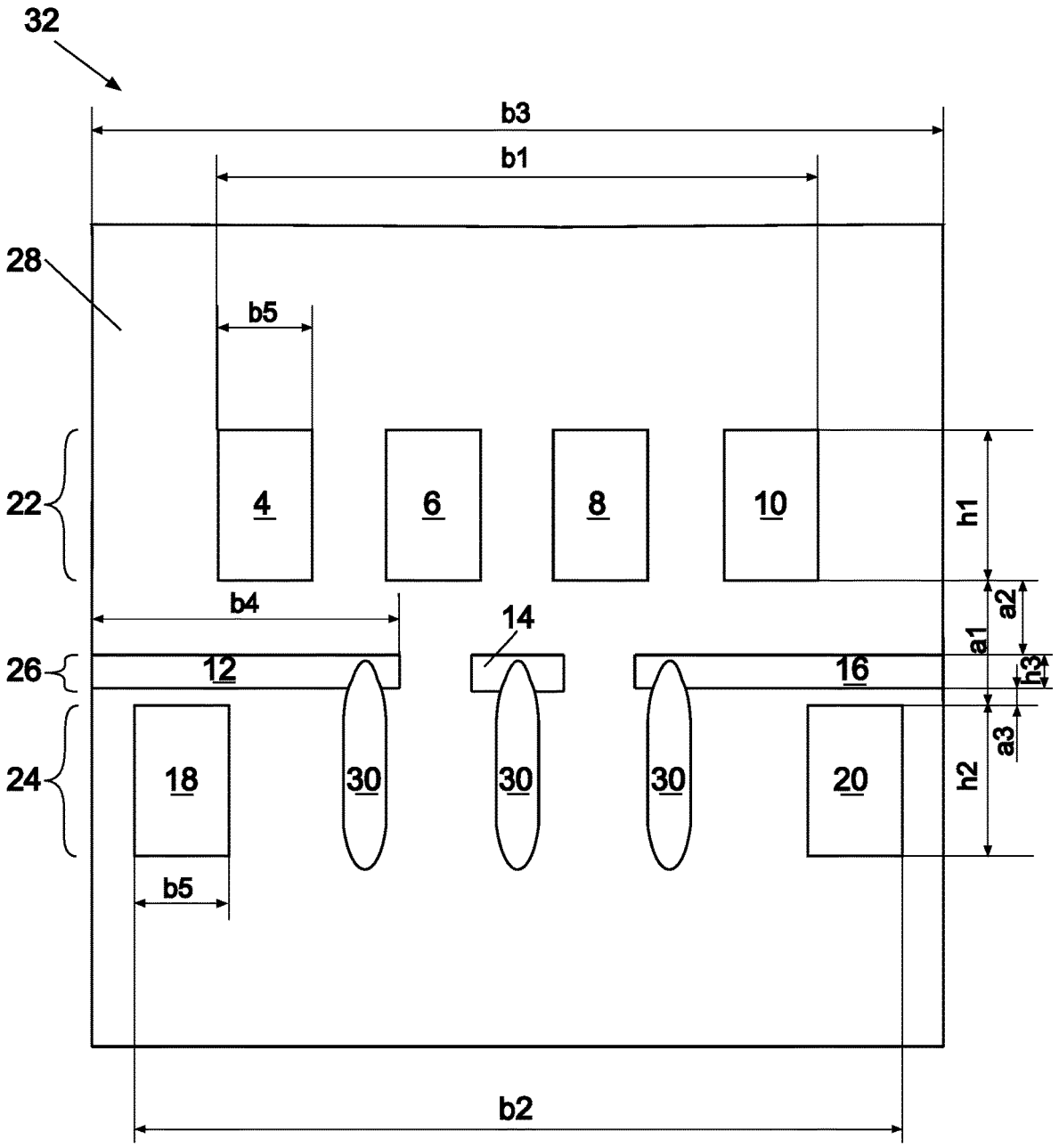
FIG. 2 shows a further circuit board according to the invention.

FIG. 2 shows a circuit board 32 for a printer cartridge, wherein, in contrast to the variant shown in FIG. 1, the contact pads 12 and 16 in the variant of FIG. 2 are rectilinearly extended in a space-saving manner and the cutouts 30 are narrow, substantially oval, slots.

Figure 3:
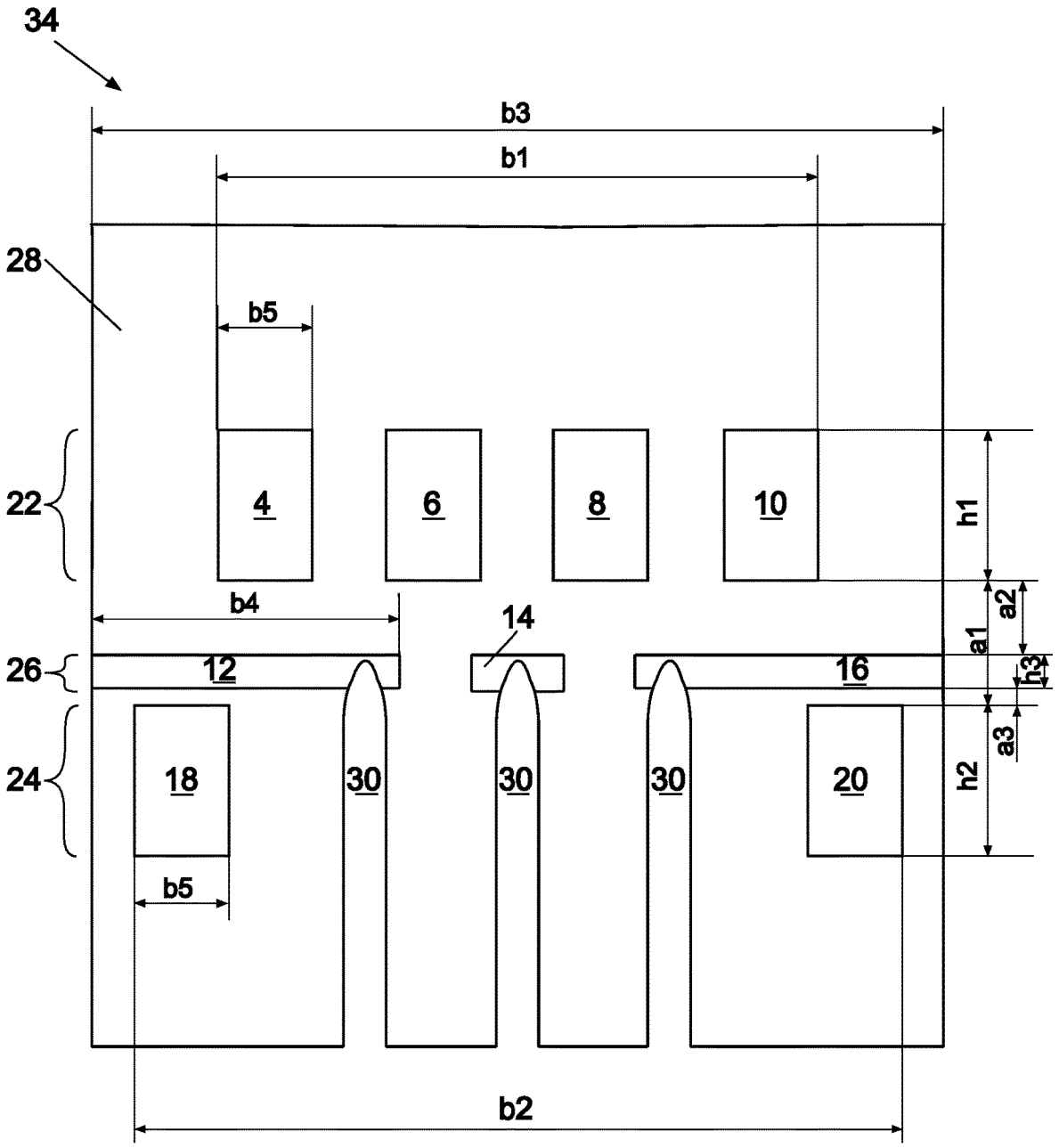
FIG. 3 shows a further circuit board according to the invention.

FIG. 3 shows a variant for a circuit board 34 that differs from the exemplary embodiments shown in FIG. 1 and FIG. 2 by virtue of the cutouts 30 having been introduced into the plate 28 in comb style and being open in the region of an end that is remote from the contact pads 12, 14, 16.

Figure 4:
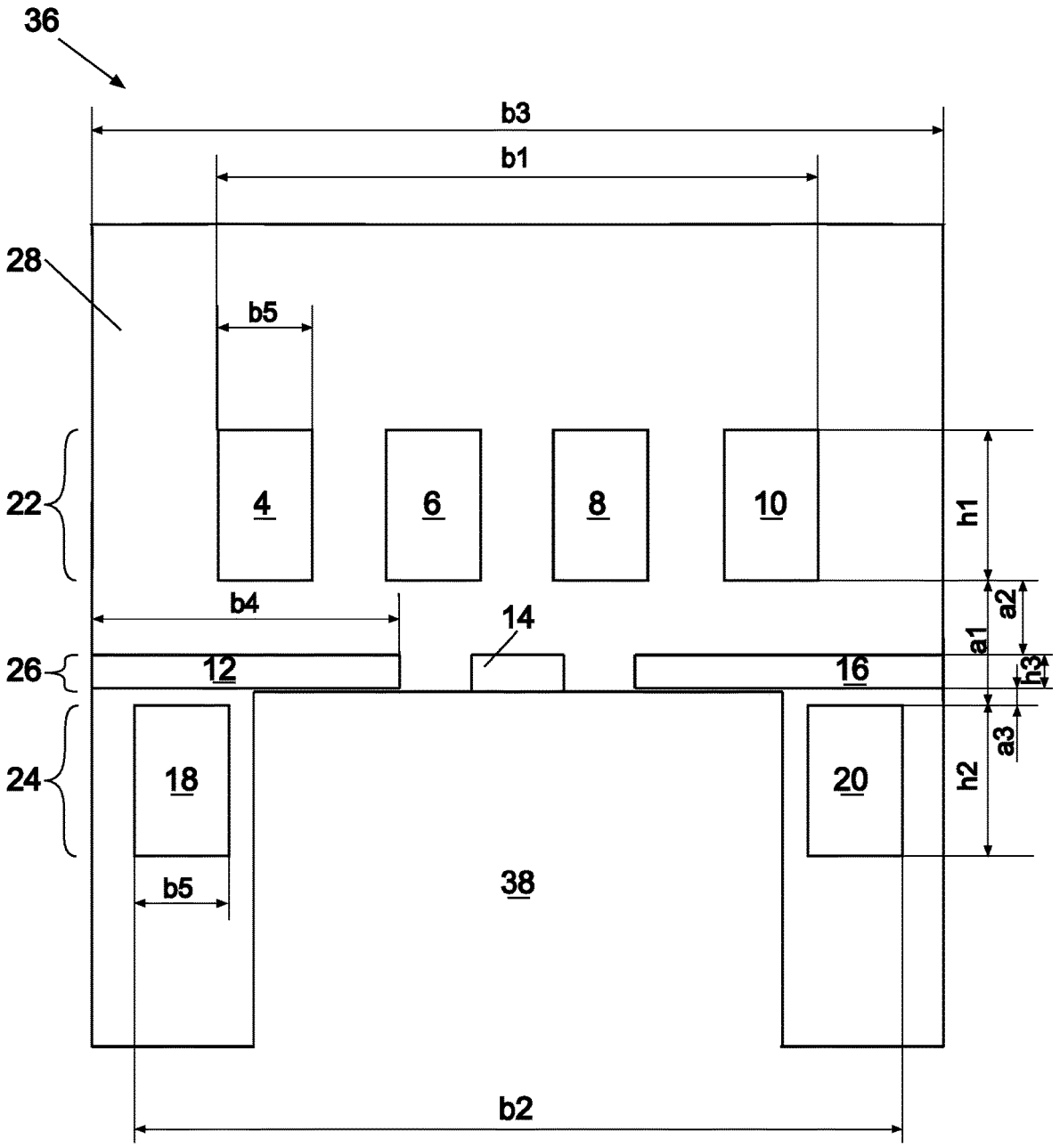
FIG. 4 shows a further circuit board according to the invention.

With the circuit board 36, FIG. 4 shows a further variant, which differs from the preceding exemplary embodiments of FIGS. 1, 2 and 3 by virtue of there now being provision for a single cutout 38 instead of three separate cutouts 30, said single cutout being open in a region that is remote from the contact elements 12, 14, 16.

A common feature of all of the exemplary embodiments described above is that there is no overlap between the first row 22, the second row 24 and the third row 26.

Figure 5A:
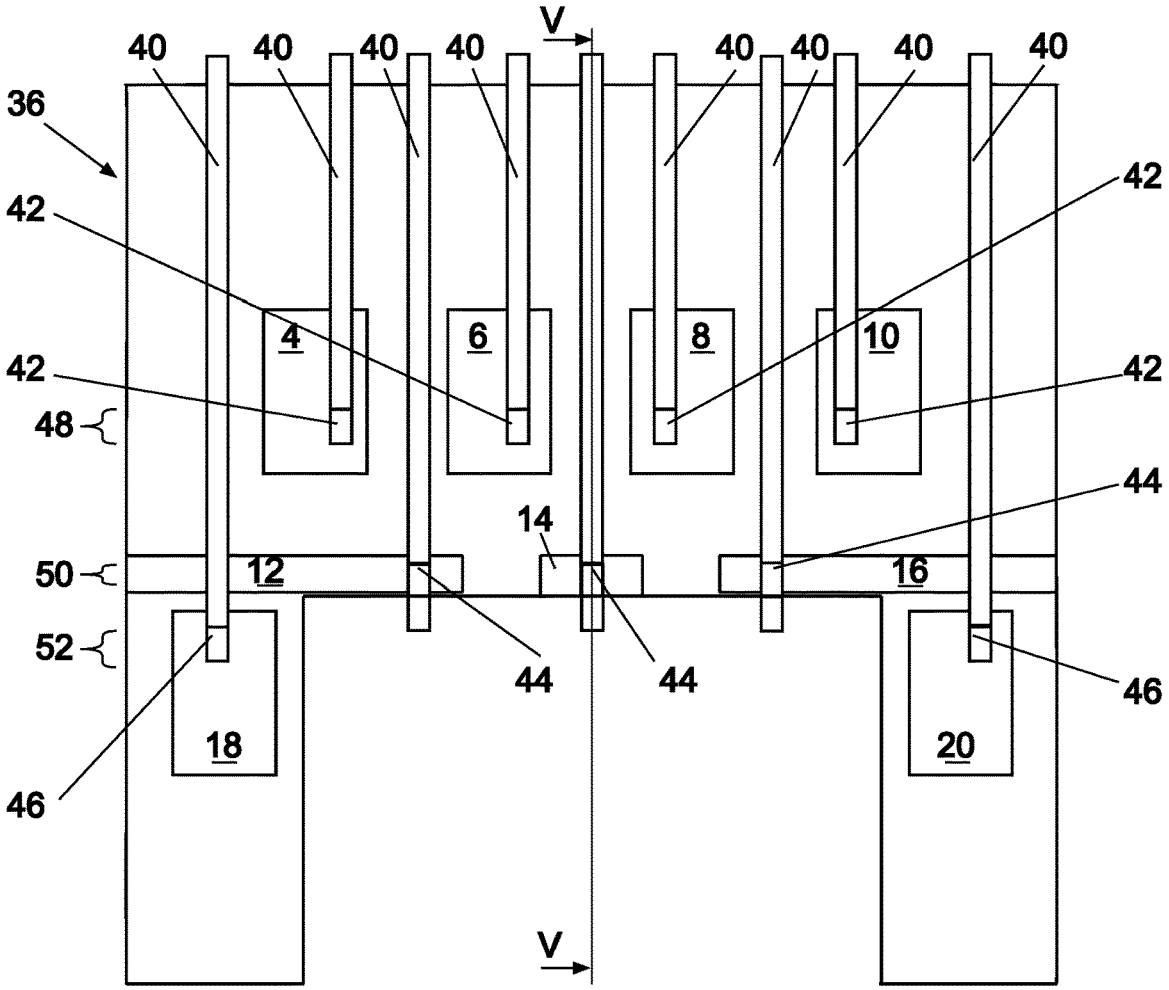
FIG. 5 shows a further circuit board according to the invention.
Figure 5B:
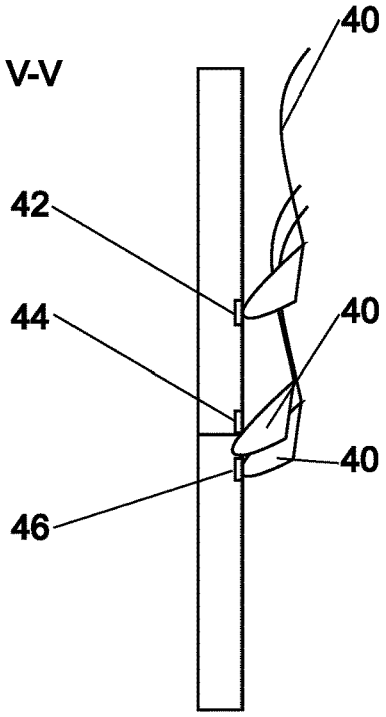

Using the circuit board 36, an exemplary description of how contacts can be made with a circuit board and printer-based contact elements is provided with reference to FIG. 5*a* and FIG. 5*b*.

A printer contains a plurality of contact elements 40, which substantially consist of spring arms that are brought into abutment with the contact pads 2-20. In the state in which a printer cartridge has finished being mounted, the contact elements 40 abut the contact pads 2-20 under sprung elastic tension.

The contact pads of the circuit board 36 and the contact elements 40 of the printer have abutment regions 42, 44, 46 formed between them in this manner, the abutment regions 42 being arranged in an abutment row 48, the abutment regions 44 being arranged in an abutment row 50 and the abutment regions 46 being arranged in an abutment row 52. As can be seen from FIG. 5, a spacing between the abutment regions 46 of the abutment row 52 is greater than a total width of the abutment row 48.

FIG. 5*b* schematically shows an abutment of the contact elements 40 on the circuit board 36 in a cross section.

Figure 6:
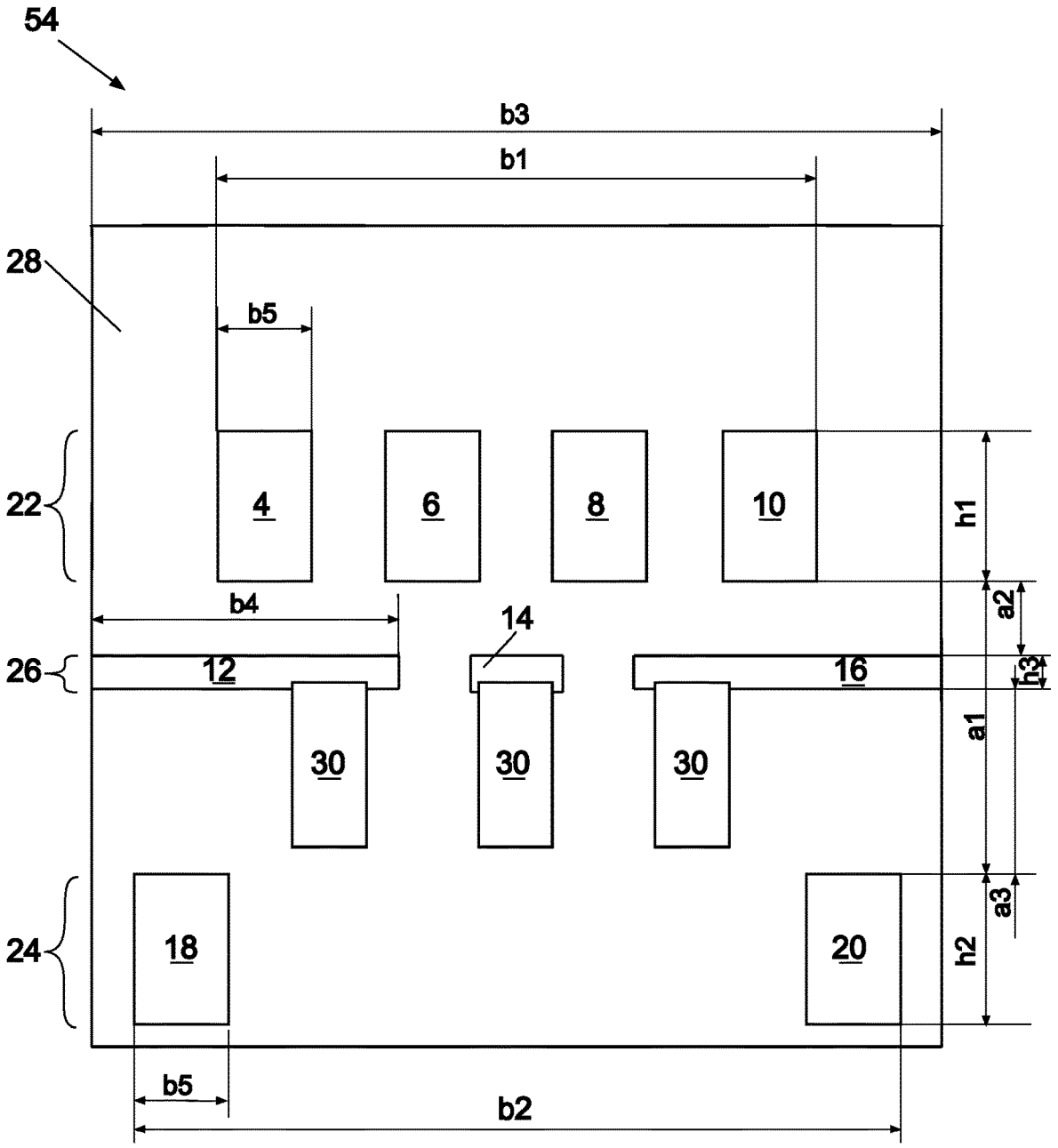
FIG. 6 shows a further circuit board according to the invention.

FIG. 6 shows a further variant of a circuit board 54, which differs from the exemplary embodiments described above by virtue of the cutouts 30 being arranged with an offset with respect to the contact pads 18, 20 and, contrary to the exemplary embodiments described above, the cutouts 30 accordingly not being accompanied at the sides by the contact pads 18, 20.

Figure 7:
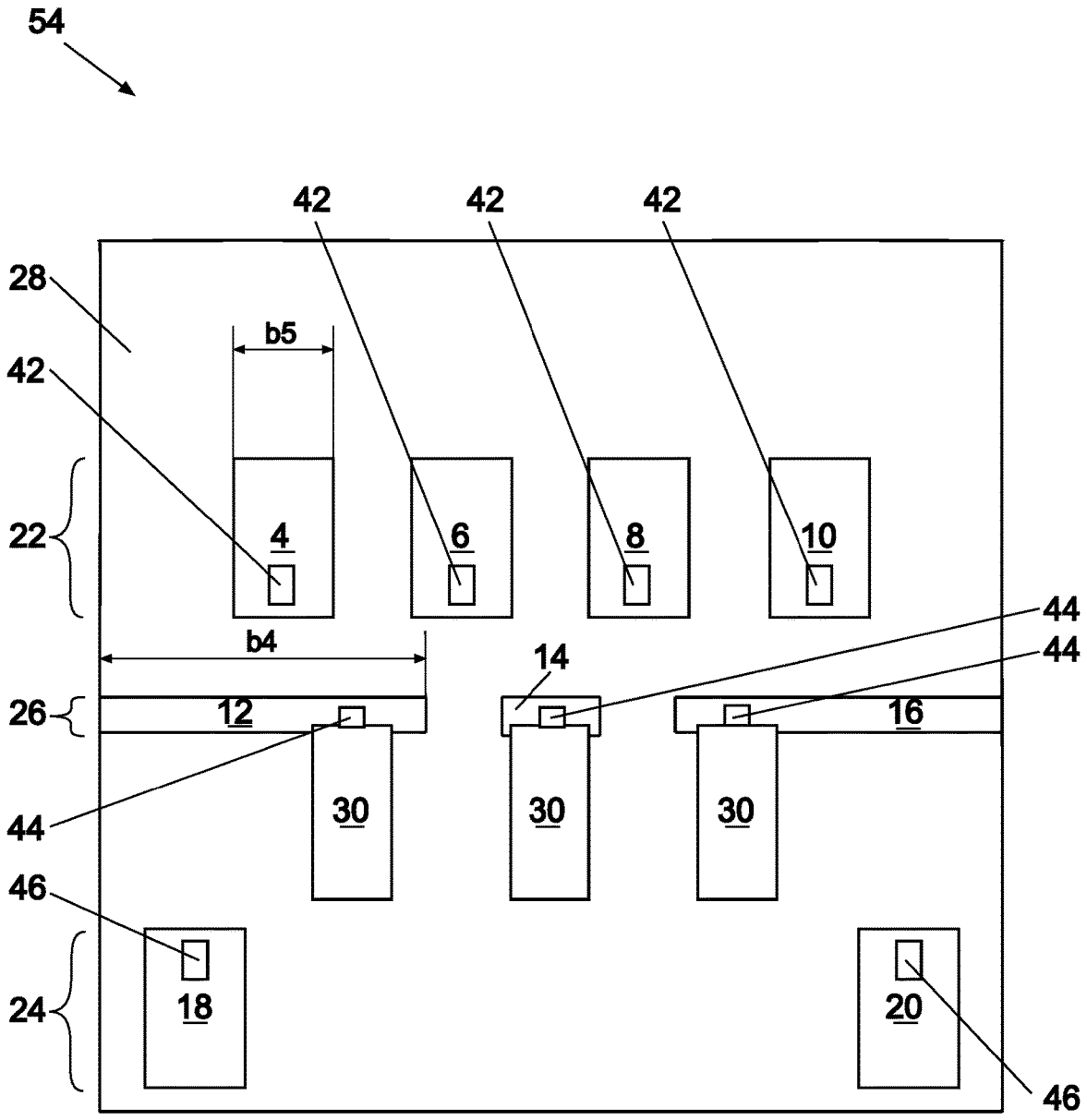
FIG. 7 shows a further circuit board according to the invention.

FIG. 7 illustrates the arrangement of abutment regions 42, 44, 46 for contact elements (not depicted) of a printer, for example in order to bring a storage medium of a printer cartridge into contact with a printer.

Figure 8:
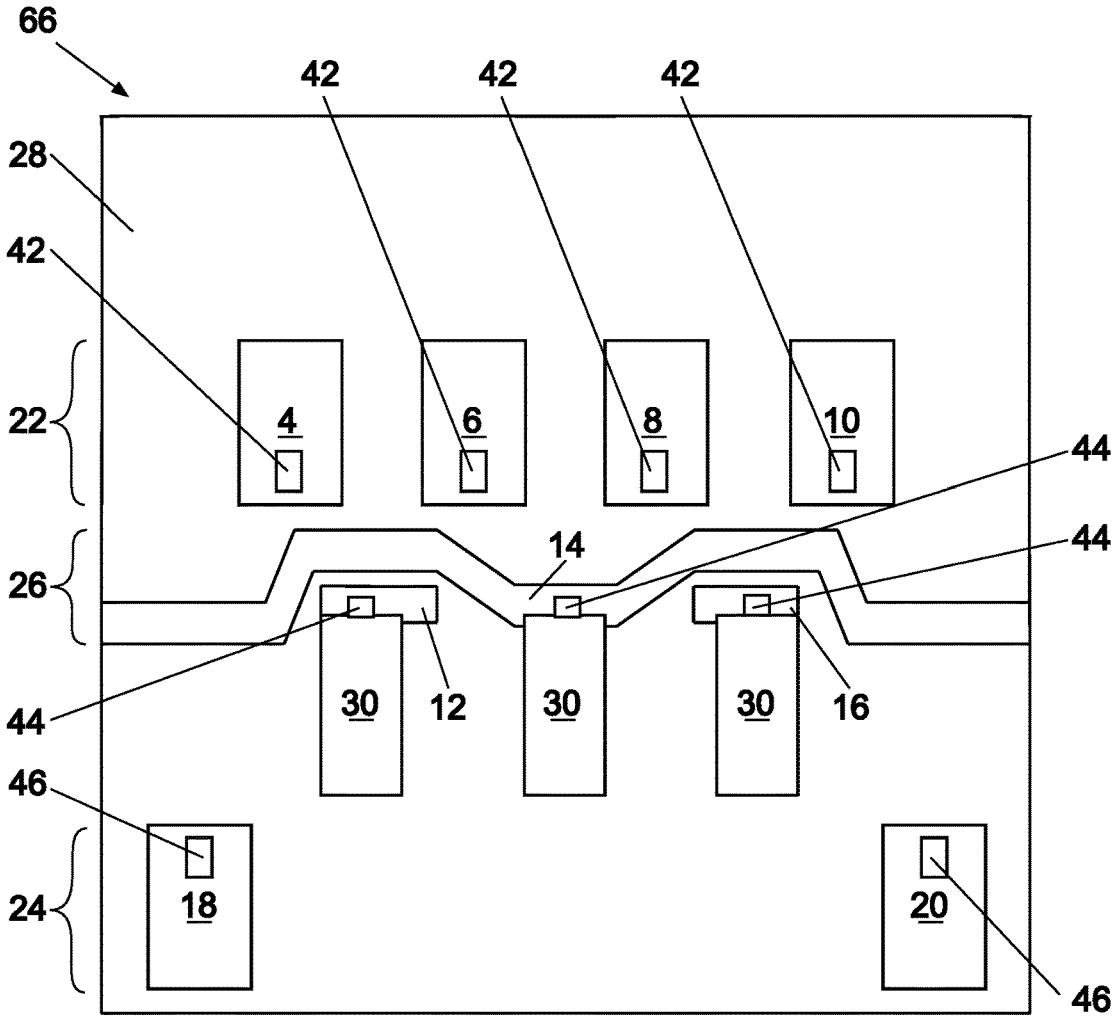
FIG. 8 shows a further circuit board according to the invention.

FIG. 8 shows a further variant of a circuit board 66, which differs from the preceding exemplary embodiments by virtue of the contact pad 14 of the third row 26 spanning the contact pads 12, 16 of the third row and/or the contact pads 18, 20 of the second row 24, wherein the spanning contact pad 14 is a grounding connection.

Figure 9:
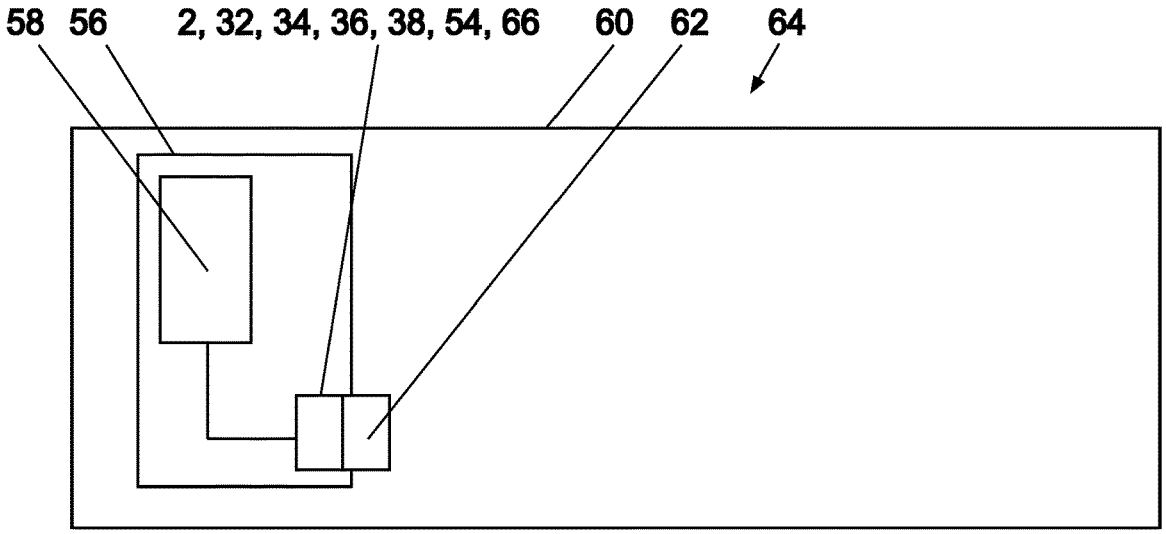
FIG. 9 shows a printing system, a printer cartridge according to the invention and a printer according to the invention.

FIG. 9 shows a printing system 64, having a printer cartridge 56, having a circuit board 2, 32, 34, 36, 38, 54, 66 and having a memory 58 connected to the circuit board. The printer cartridge 56 is inserted into a printer 60, which has a contact device 62 that carries contact elements (not depicted).

REFERENCE SIGNS

2 Circuit board
4, 6, 8, 10, 12, 14, 16, 18, 20 Contact pads
22 First row
24 Second row
26 Third row
28 Plate
30 Cutout
32 Circuit board
34 Circuit board
36 Circuit board
38 Cutout
40 Contact elements
42 Abutment regions
44 Abutment regions
46 Abutment regions
48 Abutment row
50 Abutment row
52 Abutment row
54 Circuit board
56 Printer cartridge
58 Memory
60 Printer
62 Contact device
64 Printing system
66 Circuit board
h1 Height
h2 Height
h3 Height
b1 Width
b2 Width b3 Width
b4 Width
b5 Width

What is claimed is:

1. A circuit board for a printer cartridge, comprising:
a plurality of contact pads;
wherein two or more of the contact pads are arranged in a first row;
wherein two or more of the contact pads are arranged in a second row;
wherein the first row has a spacing from the second row;
wherein the contact pads of the second row are configured to apply a higher operating voltage than the contact pads of the first row; and
wherein, in the second row, the contact pads are exclusively configured to apply the higher operating voltage.

2. The circuit board as claimed in claim 1, wherein:
two or more contact pads are arranged in a third row;
the third row is arranged between the first row and the second row;
the third row has a spacing from the first row and the second row; and
the contact pads of the second row are configured to apply a higher operating voltage than the contact pads of the third row.

3. The circuit board as claimed in claim 2, wherein:
a contact pad of the second row and a contact pad of the first row have at least one contact pad of the third row arranged between them; or
each contact pad of the second row and a contact pad of the first row have at least one contact pad of the third row arranged between them.

4. The circuit board as claimed in claim 2, wherein:
at least one contact pad of the third row has a width that is greater than a width of a contact pad of the first row or of the second row; and/or
at least one contact pad of the third row has a height that is less than a height of a contact pad of the first row or of the second row.

5. The circuit board as claimed in claim 2, wherein:
the contact pads are arranged on a plate made of electrically insulating carrier material;
the plate has a single cutout between the contact pads of the second row and wherein at least the contact pads of the third row adjoin the cutout; or
the plate has two or more cutouts spaced apart from one another and wherein at least one contact pad of the third row adjoins a respective one of the cutouts.

6. The circuit board as claimed in claim 2, wherein at least two of the contact pads of the third row each have an elevation, said elevations being configured for the abutment of a respective contact element of a printer.

7. The circuit board as claimed in claim 2, wherein:
one of the contact pads of the third row is a grounding connection; and/or
one of the contact pads of the third row is a power supply connection; and/or
one of the contact pads of the third row is a clock connection; and/or
one of the contact pads of the third row is a reset connection; and/or
one contact pad of the third row is a data connection.

8. The circuit board as claimed in claim 2, wherein:
the third row has precisely three contact pads; and/or
one contact pad of the third row spans at least two contact pads of the third row and/or the contact pads of the second row, wherein the spanning contact pad is a grounding connection.

9. The circuit board as claimed in claim 1, wherein the first row has precisely four contact pads and/or the second row has precisely two contact pads.

10. The circuit board as claimed in claim 1, wherein:
at least two contact pads of the first row are configured to make contact with a short-circuit detection device of a printer; and/or
at least one of the contact pads of the first row is a grounding connection; and/or
one of the contact pads of the first row is a power supply connection; and/or
one of the contact pads of the first row is a clock connection; and/or
one of the contact pads of the first row is a reset connection; and/or
one contact pad of the first row is a data connection.

11. The circuit board as claimed in claim 1, wherein a spacing between end contact pads of the second row is greater than a length of the first row.

12. The circuit board as claimed in claim 1, comprising a memory, wherein:
the memory is connected to at least some of the contact pads; and
the contact pads of the second row are configured to apply a voltage that is higher than the supply voltage of the memory.

13. A printer cartridge, comprising:
a housing that has a supply volume for supplying ink; and
a circuit board comprising a plurality of contact pads;
wherein two or more of the contact pads are arranged in a first row;
wherein two or more of the contact pads are arranged in a second row;
wherein the first row has a spacing from the second row;
wherein the contact pads of the second row are configured to apply a higher operating voltage than the contact pads of the first row; and
wherein, in the second row, the contact pads are exclusively configured to apply the higher operating voltage.

14. A printing system, comprising:
a printer and a printer cartridge inserted into the printer;
the printer cartridge comprising a housing that has a supply volume for supplying ink and a circuit board comprising a plurality of contact pads;
wherein two or more of the contact pads are arranged in a first row;
wherein two or more of the contact pads are arranged in a second row;
wherein the first row has a spacing from the second row;
wherein the contact pads of the second row are configured to apply a higher operating voltage than the contact pads of the first row;
wherein, in the second row, the contact pads are exclusively configured to apply a higher operating voltage; and
wherein the printer has contact elements that abut the contact pads of the circuit board of the printer cartridge.

15. The printing system as claimed in claim 14, wherein:
the contact elements and the contact pads have abutment regions formed between them;
abutment regions of the contact pads of the first row are arranged in a first abutment row; and/or abutment regions of the contact pads of the second row are arranged in a second abutment row; and/or abutment regions of the contact pads of the third row are arranged in a third abutment row, which is arranged between the first abutment row and the second abutment row.

16. The printing system as claimed in claim 15, wherein a spacing between end abutment regions of the second row is greater than a length of the first abutment row.

17. The printing system as claimed in claim 14, wherein:

the abutment regions have no overlap as seen in a direction transverse to the longitudinal extent of the rows; and/or the contact elements of the printer are arranged in two rows in the state in which they are not in contact with the contact pads.

* * * * *